US005140954A

United States Patent [19]

Kubsch

[11] Patent Number: 5,140,954

[45] Date of Patent: Aug. 25, 1992

[54] CONCENTRIC VALVE STRUCTURE

[76] Inventor: William N. Kubsch, S. Mountain Rd., Hillside Lake, Wappingeis Falls, N.Y. 12590

[21] Appl. No.: 702,013

[22] Filed: May 17, 1991

[51] Int. Cl.[5] ..... F01L 1/28

[52] U.S. Cl. ..... 123/79 C

[58] Field of Search ..... 123/79 C, 188 R, 188 AA

[56] References Cited

U.S. PATENT DOCUMENTS

| | | | |
|---|---|---|---|
| 1,329,811 | 2/1920 | Smith | 123/79 C |
| 2,658,488 | 11/1953 | Taub | 123/79 C |
| 2,863,429 | 12/1958 | Bouteleux | 123/79 C |
| 2,958,316 | 11/1960 | Buchi | 123/79 C |
| 4,449,490 | 5/1984 | Hansen | 123/79 C |
| 4,649,872 | 3/1987 | Solheim | 123/79 C |
| 5,000,135 | 3/1991 | Taguma | 123/79 C |

FOREIGN PATENT DOCUMENTS 3600067 7/1987 Fed. Rep. of Germany .... 123/79 C

*Primary Examiner*—David A. Okonsky
*Attorney, Agent, or Firm*—Leon Gilden

[57] ABSTRACT

A concentric valve includes a first cylindrical housing and a concentric second cylindrical housing, with the second cylindrical housing defining an internal combustion intake valve mounted within an associated overhead valve assembly. An exhaust valve is mounted concentrically of the second housing, wherein the first housing directs intake flow through the intake valve and the exhaust valve directing flow coaxially of the first and second cylindrical housing through an annular array of windows in the first cylindrical housing to direct exhaust flow exteriorly thereof.

4 Claims, 4 Drawing Sheets

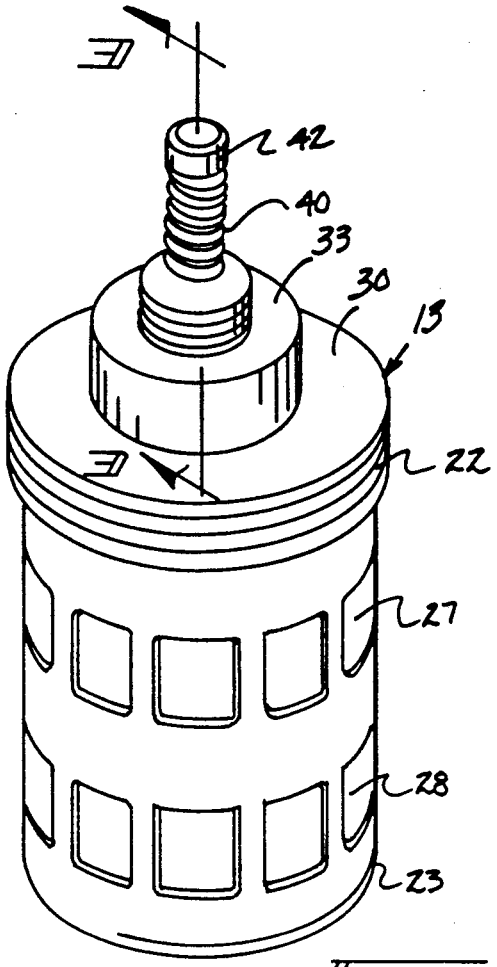
Fig 4
Fig 3
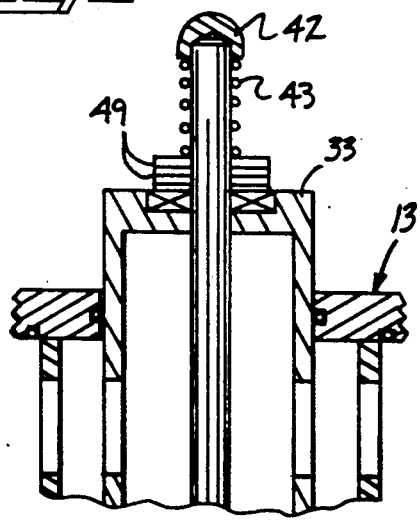

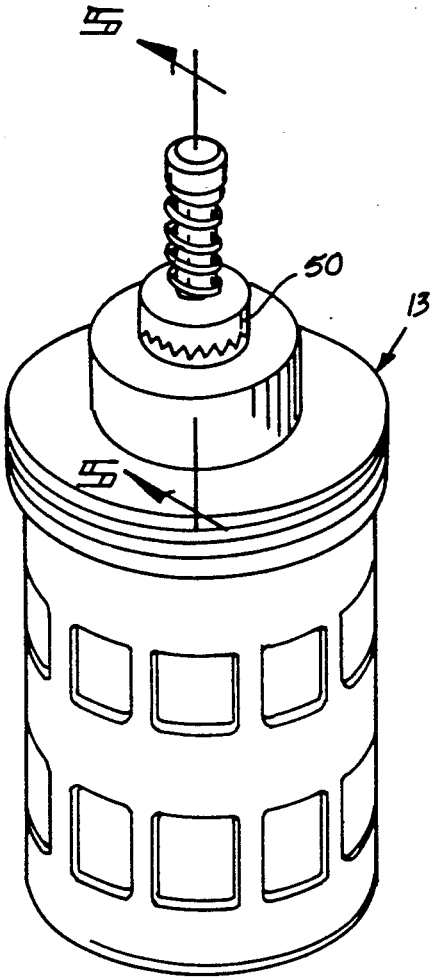
Fig 6
Fig 5
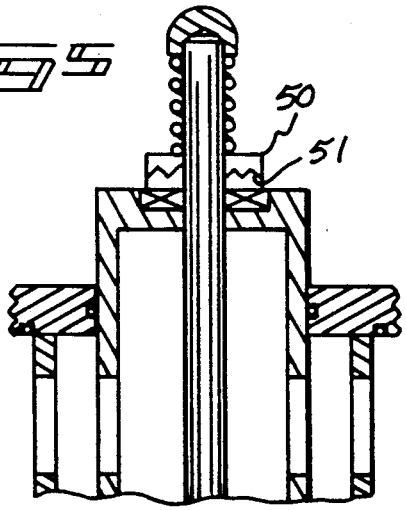

CONCENTRIC VALVE STRUCTURE

BACKGROUND OF THE INVENTION

1. Field of the Invention

The field of invention relates to overhead valve apparatus for use in an internal combustion engines, and more particularly pertains to a new and improved concentric valve structure for use in an internal combustion engine and associated with an overhead cam structure.

2. Description of the Prior Art

Various valve apparatus is utilized in the prior art to direct flow into and out of a combustion chamber of a typical four-stroke internal combustion engine. The instant invention attempts to overcome deficiencies of the prior art by providing a readily replaceable intake and exhaust coaxial arrangement readily mounted and removed relative to a head member of an internal combustion engine for efficiency of use and maintenance thereof.

Examples of the prior art include U.S Pat. No. 3,589,346 to Warren setting forth a typical example of a push rod actuated valve structure utilized in a conventional internal combustion engine, wherein the valve structure utilizes a cup-shaped member for enhanced alignment of the valve relative to the actuation of an associated rocker arm.

U.S. Pat. No. 3,722,484 to Gordini sets forth an overhead cam structure for utilization within valves of an internal combustion engine.

U.S. Pat. No. 4,205,634 to Tourtelot provides for a timing mechanism for use in overhead cam engines defined as a wedge interposed selectively between an overhead cam and an underlying valve.

U.S. Pat. No. 4,497,307 to Parr, et al. and U.S. Pat. No. 3,301,238 to Hanley are further examples of rocker arm actuated valves mounted within a head member of an internal combustion engine.

As such, it may be appreciated that there continues to be a need for a new and improved concentric valve structure for use in internal combustion engines as set forth by the instant invention which addresses both the problems of ease of use as well as effectiveness in construction in ease of maintenance and replacement of such valve structure and efficiency of positioning such valve structure relative to an internal combustion engine.

SUMMARY OF THE INVENTION

In view of the foregoing disadvantages inherent in the known types of internal combustion engine valve arrangements now present in the prior art, the present invention provides a concentric valve structure utilized in internal combustion engines concentrically positioning the intake and exhaust valves relative to an internal combustion engine in use for ease of positioning and maintenance thereof. As such, the general purpose of the present invention, which will be described subsequently in greater detail, is to provide a new and improved concentric valve structure which has all the advantages of the prior art internal combustion engine valve arrangements and none of the disadvantages.

To attain this, the present invention provides a concentric valve including a first cylindrical housing and a concentric second cylindrical housing, with the second cylindrical housing defining an internal combustion intake valve mounted within an associated overhead valve assembly. An exhaust valve is mounted concentrically of the second housing, wherein the first housing directs intake flow through the intake valve and the exhaust valve directing flow coaxially of the first and second cylindrical housing through an annular array of windows in the first cylindrical housing to direct exhaust flow exteriorly thereof.

My invention resides not in any one of these features per se, but rather in the particular combination of all of them herein disclosed and claimed and it is distinguished from the prior art in this particular combination of its structures for the functions specified.

There has thus been outlined, rather broadly, the more important features of the invention in order that detailed desription thereof that follows may be better understood, and in order that the present contribution to the art may be better appreciated. There are, of course, additional features of the invention that will described hereinafter and which will form the subject matter of the claims appended hereto. Those skilled in the art will appreciate that the conception, upon which this disclosure is based, may readily be utilized as a basis for the desighning of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and the essence of the technical disclosure of the application. The abstract is neither intended to define the invention of the application, which is measured by claims, nor is it intended to be limiting as to the scope of the invention in any way.

It is therefore an object of the present invention to provide a new and improved concentric valve structure which has all the advantages of the prior art internal combustion engine valve arrangements and none of the disadvantages.

It is another object of the present invention to provide a new and improved concentric valve structure which may be easily and efficiently manufactured and marketed.

It is a further object of the present invention to provide a new and improved concentric valve structure which is of a durable and reliable construction.

An even further object of the present invention is to provide a new and improved concentric valve stucture which is susceptible of a low cost of manufacture with regard to both naterials and labor, and which accordingly is then susceptible of low prices of sale to the consuming public, thereby making such concentric valve structures economically available to the buying public.

Still yet another object of the present invention is to provide a new and improved concentric valve structure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed desription thereof. Such description makes reference to the annexed drawings wherein:

FIG. 3 is an orthographic view, taken along the lines 3—3 of FIG. 4 in the direction indicated by the arrows.

FIG. 4 is an isometric illustration of the valve assembly of the instant invention.

FIG. 5 is an orthographic view, taken along the lines 5—5 of FIG. 6 in the direction indicated by the arrows.

FIG. 6 is an isometric illustration of the valve assembly of the instant invention utilizing a modified cam follower surface.

DESCRIPTION OF THE PREFERRED EMBODIMENT

Figure 1:
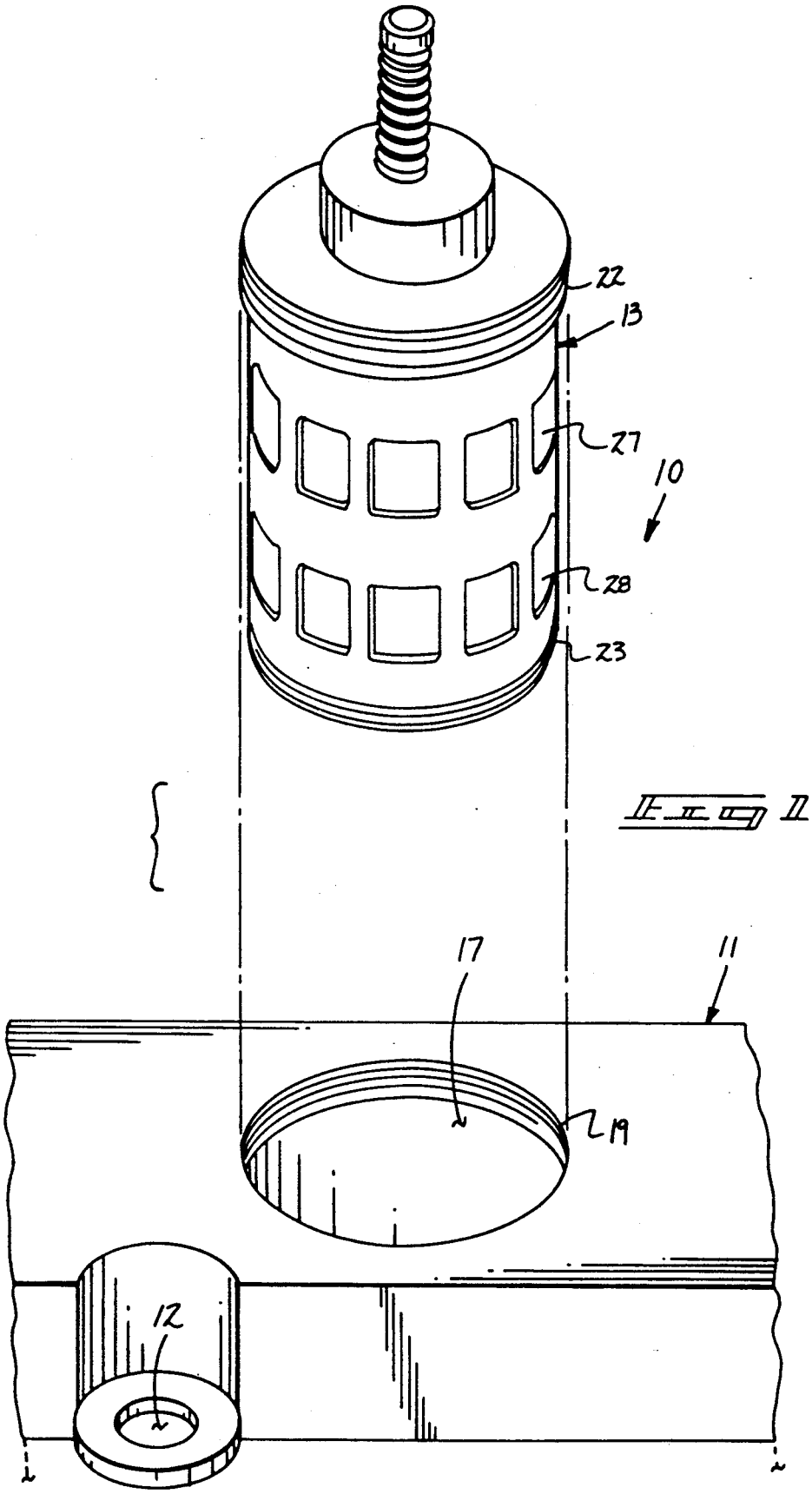
FIG. 1 is an isometric illustration of the instant invention for mounting relative to a head assembly of an internal combustion engine.
Figure 2:
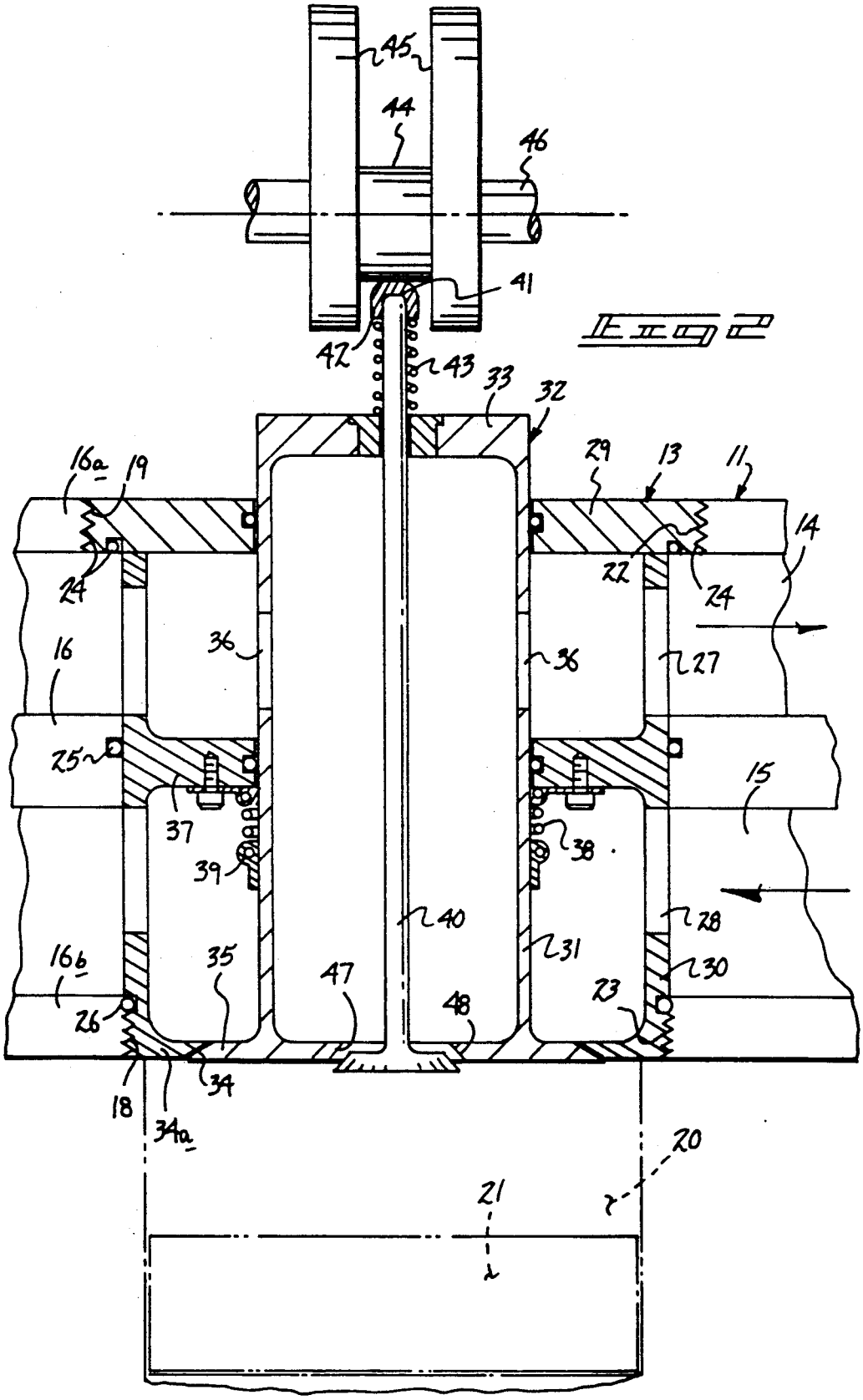
FIG. 2 is an orthographic cross-sectional illustration of the instant invention mounted within the head assembly relative to a combustion chamber of an internal combustion engine.

With reference now to the drawings, and in particular to FIGS. 1 to 6 thereof, a new and improved concentric valve structure embodying the principles and concepts of the present invention and generally designated by the reference numeral 10 will be described.

More specifically, the concentric valve structure 10 of the instant invention essentially comprises a valve assenbly 13 selectively securable within a cylinder head 11, utilizing securement bores 12 to receive a fastener therethrough to mount the cylinder head to a reciprocating lower block assembly of an internal combustion engine to orient the valve assembly 13 over a combustion chamber 20 (see FIG. 2) reciprocatingly mounting a piston 21 therewithin.

The cylinder head 11 includes a cylinder head valve assembly receiving bore 17. The bore 17 includes a receiving bore lower threaded end 18 and the receiving bore upper threaded end 19, including helical internal threads at the lower upper terminal ends of the bore 17. The lower and upper threaded ends 18 and 19 respectivley are selectively secureable to lower and upper cylindrical housing externally threaded ends 23 and 22 of a cylindrical first side wall 30. The cylinder head 11 includes an exhaust gas passageway 14 positioned between a central divider wall 16 directed medially of the cylinder head 11 and longitudinally thereof to direct exhaust gas through the cylinder head, with a cylinder head bottom wall **16*b* spaced below the central divider wall 16 defining an intake mixture passageway 15 about the receving bore 17. Respective first, second and third annular seals 24, 25, and 26 are interfaced within the cylinder head 11 and the valve assembly 13. Specifically, the first annular seal 24 is interfaced between the top wall 16*a* and a first cylindrical housing top wall 29. The second annular seal 25 is interfaced between a first cylinder housing medial wall 37 and the central divider wall 16. The third annular seal 26 is interfaced between the cylinder head bottom wall 16*b* and the first cylindrical housing bottom wall 34*a*, as illustrated, to effect sealing of mixtures in containing a greater relationship betwwen the intake and exhaust passageways and their counterparts with the valve assembly 13 during the combustion process. The valve assembly 13 is defined by a first exterior cylindrical housing that is defined by the first cylindrical housing first side wall 30 that is concentric about a cylindrical housing second side wall 31 of a second cylindrical housing that is coaxially aligned and received reciprocatingly within the first cylindrical housing. The first cylindrical housing includes the first cylindrical housing top wall 29 spaced from and parallel the first cylindrical housing bottom wall 34*a* defining a first axial length. The second cylindrical housing 32 defines a central valve cylinder of a second length greater than the first length to include a central valve top wall 33 positioned above the first cylindrical housing top wall 29. The first cylindrical housing medial wall 37 that orthogonally projects between the first cylindrical housing side wall 30 and the second cylindrical housing side wall 31 captures a first cross spring 38 between a bottom surface of the first cylindrical housing medial wall 37 and a first spring annular abutment 39 that is mounted to the second cylindrical housing side wall 31. A conical intake seat 34 is directed through the first cylindrical housing bottom wall 34*a* and complementarily mates an intake housing valve face 35 as defined by an annular flange mounted to the lower terminal end of the second cylindrical housing side wall 31. Medially of the conical intake housing valve face 35 is a conical intake valve central opening that complementarily mates with a conical exhaust face 48 formed at a lower terminal end of an exhaust valve 40 extending orthogonally and medially through the second cylindrical housing top wall 33. An upper terminal end of the exhaust valve 40 mounts an exhaust valve cap 42 thereon for cooperation with a first cam face 44 to effect actuation of the exhaust valve 40. A single plurality of second cam faces 45 mounted to the cam shaft 46 are in overlying position relative to the second cylindrical housing top wall 33 to effect reciprocation of the second cylindrical housing 33 that functions as an intake valve directing flow from the intake mixture passageway 15 into the combustion chamber 20. Depressing of the exhaust valve 40 by the sequenced timing of the first cam face 44 subsequent to combustion within the combustion chamber 20 directs exhaust flow through the second cylindrical housing and its associated second cylindrical housing windows 36 that are aligned with the annular array of first windows 27 to direct exhaust flow through the exhaust gas passageway 14. The second windows 28 maintain communication of the intake mixture passageway 15 with the combustion chamber 20 through reciprocation of the second cylindrical housing 32** relative to the first cylindrical housing.

FIGS. 3 and 4 illustrate the use of cylindrical disc members 49 interposed between the second crawl spring 43 and the second cylindrical housing top wall 33 to effect selective altering of cam duration and valve lift relative to the valve intake seat 34. FIGS. 5 and 6 illustrate the use of serrated confronting faces 51 that are in a mating interdigited communication relative to one another to position and fix the cylindrical discs 49 relative to one another preventing unwarranted and undesirable relative rotation of the cylindrical disc relative to one another when functioning as a mechanism to alter cam timing and lift in use with an internal combustion engine.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A concentric valve structure, comprising in combination, a cylinder head, the cylinder head including a receiving bore, and a valve assembly securable within the receiving bore, the valve assembly including a first cylindrical housing fixed mounted to the receiving bore, and a second cylindrical housing reciprocatably mounted within the first cylindrical housing, and the cylinder head including an exhaust gas passageway, and the first cylindrical housing including an annular array of first windows aligned with the exhaust gas passageway, and the cylinder head including an intake mixture passageway, and the first cylindrical housing including an annular array of second windows aligned with the intake mixture passageway, and the second cylindrical housing including an annular array of second cylindrical housing windows in pneumatic communication with the annular array of first windows, and the first cylindrical housing coaxially aligned with the second cylindrical housing, and the second cylindrical housing defined by a second length, the first cylindrical housing defined by a first length, wherein the second length is greater than the first length, and an exhaust valve coaxially directed through the second cylindrical housing, wherein the second cylindrical housing includes a second cylindrical housing top wall and the exhaust valve projects orthogonally and above the second cylindrical housing top wall, and a cam shaft, the cam shaft including a first cam lobe in operative association with the exhaust valve, and at least one further cam lobe in operative communication with the second cylindrical housing top wall, wherein the second cam lobe is arranged to displace the second cylindrical housing relative to the first cylindrical housing, and the first cam lobe is arranged to displace the exhaust valve relative to the second cylindrical housing, and the first cylindrical housing includes a first cylindrical housing top wall spaced from and parallel a first cylindrical housing bottom wall, and a first cylindrical housing medial wall orthogonally oriented between the first cylindrical housing and the second cylindrical housing and between the annular array of the first windows and the annular array of the second windows, and a first spring member captured between the first cylindrical housing medial wall and the second cylindrical housing, and an abutment means mounted to the second cylindrical housing below the first spring member to mount a lower terminal end of the first spring member, and wherein the first cylindrical housing bottom wall includes a conical first opening, the conical first opening complementarily receiving an intake housing valve face defining a second cylindrical housing bottom wall, and the second cylindrical housing bottom wall, including a further conical opening, the further conical opening complementarily receiving a conical exhaust valve head defining a lower terminal end of the exhaust valve, and a second spring member, and a cap member, the cap member fixedly mounted to a lower terminal end of the exhaust valve and the second spring member captured between the cap member and the second cylindrical housing top wall.

2. An apparatus as set forth in claim 1 wherein the receiving bore includes an upper threaded end and a lower threaded end, and the first cylindrical housing includes a first cylindrical housing externally threaded upper terminal end, and a first cylindrical housing externally threaded lower terminal end, the lower cylindrical housing externally threaded upper terminal end threadedly securable to the receiving bore upper terminal end, and the first cylindrical housing externally threaded lower terminal end threadedly securable to the receiving bore threaded lower terminal end.

3. An apparatus as set forth in claim 2 including a plurality of disc members captured between the second spring member and the second cylindrical housing top wall.

4. An apparatus as set forth in claim 3 wherein the disc members each include interdigited confronting faces to maintain adjacent cylindrical discs in a fixed relationship relative to one another.

* * * * *